United States Patent [19]

Grzanowski, Jr. et al.

[11] Patent Number: 4,642,477

[45] Date of Patent: Feb. 10, 1987

[54] AUTOMATIC LIGHT SIGNALLING SYSTEM

[76] Inventors: Edmund S. Grzanowski, Jr., 35311 Barton Dr., Westland, Mich. 48185; Philip J. Glengary, 4542 Walden Dr., Birmingham, Mich. 48010

[21] Appl. No.: 740,564

[22] Filed: Jun. 3, 1985

[51] Int. Cl.[4] ..... H01H 47/00

[52] U.S. Cl. ..... 307/113; 307/112; 307/115; 307/116; 340/502; 340/503; 340/326; 361/166; 361/167

[58] Field of Search ..... 340/815.21, 326, 641–643, 340/693, 502–509; 307/112–117; 361/166, 167, 170, 173, 187, 189, 191, 168.1, 195, 196, 203

[56] References Cited

U.S. PATENT DOCUMENTS

| | | | |
|---|---|---|---|
| 2,888,669 | 5/1959 | Thomas et al. | 307/114 |
| 3,287,722 | 11/1966 | Craig | 307/114 |
| 3,860,910 | 1/1975 | Hudson | 307/113 X |
| 4,276,542 | 6/1981 | Russ | 340/326 |
| 4,290,057 | 9/1981 | Knight | 307/116 X |
| 4,556,863 | 12/1985 | Devitt et al. | 340/331 X |
| 4,570,155 | 2/1986 | Skarman et al. | 340/331 X |

*Primary Examiner*—William M. Shoop, Jr.

*Assistant Examiner*—Shik Luen Paul Ip

*Attorney, Agent, or Firm*—James M. Deimen

[57] ABSTRACT

An alarm actuated emergency light signalling circuit to replace the usual wall mounted light switch. The new switch circuit fits within the electrical wall box and has the external appearance and manual operation of an ordinary light switch. When triggered by an alarm system, the new light signalling circuit overrides the circuit breaking function of the light switch and causes the lighting controlled by the switch to flash intermittently. The flashing of the lighting occurs regardless of the initial state of the light switch, whether on or off. The circuit includes a low voltage portion driven by the alarm and including sensing and timing circuitry. The low voltage circuit does not require or use any electric power when not actuated by the alarm. The alternating current power circuit for the lighting is operable in the conventional on/off fashion unless actuated by the alarm and low voltage circuit. Thus, there is no additional alarm position for the switch. The flashing circuit is always ready to be actuated by the alarm and requires no manual set or reset action.

9 Claims, 7 Drawing Figures

AUTOMATIC LIGHT SIGNALLING SYSTEM

BACKGROUND OF THE INVENTION

The field of the invention pertains to means to override and control the interior or exterior lights of a structure in response to an alarm or other signal and, in particular, to compact electrical control means for indoor or outdoor lights actuatable in response to an alarm signal or other low voltage signal from an auxiliary device.

U.S. Pat. No. 4,276,542 discloses an indoor operated switch to optionally insert an audible alarm and light flashing circuit in an exterior light circuit and to thereby give notice on the outside of the home of an emergency condition inside the home. The device requires the use of a three position wall switch which turns the external light on or off in a conventional manner but provides a third or alert position which engages the flashing circuit and audible alarm circuit. The device is not actuated by an external alarm sensor or other automatic low voltage device but rather relies upon the three position switch being manually placed in the alert position to engage the flashing circuit and audible alarm circuit.

U.S. Pat. No. 4,287,509 discloses a strobe lamp triggering circuit which senses the input to an audible signalling component of a fire alarm system. The circuitry includes an optical isolation element and an emergency alternating current power supply for the strobe lamp triggering circuit. The audible signalling component sensing circuit, however, is driven by the low voltage audible fire alarm system.

U.S. Pat. No. 3,916,404 discloses circuitry activated by any one of a number of heat sensing devices so as to cause a recognizable sound and visual means to indicate the location of the exit from the structure. The circuitry requires completely separate wiring to the various lamps which operate at a low voltage from a transformer and rectified alternating current power supply or, in the event of failure of the alternating current power supply, an integral low voltage battery.

U.S. Pat. No. 4,148,023 similarly discloses an alternating current powered emergency exit indicator to signal with a high intensity light and audible alarm the location of an emergency exit. This particular circuit, however, provides for the activation of the additional high intensity light in case of emergency, in particular, a smoke emergency sensed by a detector in the circuitry. Thus, the emergency exit lights can be kept at a relatively low level sufficient to indicate the emergency exit without causing any distraction to an audience in a movie theater or night club, nevertheless providing an extremely bright smoke piercing light in the event of an emergency.

U.S. Pat. No. 4,101,880 discloses an audio-visual signalling device utilizing an inductance and an interrupter in series with the inductance. With periodic interruption of the interrupter, the inductance magnetic field periodically decays actuating a flash tube to cause a flashing signal in addition to the auditory signal.

The patents above disclose extensive low voltage circuitry or special circuitry and lighting along with auditory signalling means. Such devices are expensive to install and to service. The device in U.S. Pat. No. 4,276,542, which relies on the existing two wire power circuit to the light, requires manual operation of the alert signal to flash the light. None of the disclosed art above suggests simple, inexpensive and compact circuitry that automatically overrides an internal or external light circuit in response to an alarm signal to thereby flash the light regardless of whether the light is on or off prior to the alarm signal.

SUMMARY OF THE INVENTION

The new automatic light signalling system is intended to supplement as an add-on component the majority of currently available alarm systems. The new device replaces the usual wall mounted light switch used to control indoor or outdoor lighting and fits within the electrical wall box of the switch which it replaces. The device as installed has the external appearance and operation of an ordinary light switch.

When triggered by an alarm system, the enclosed circuitry within the device overrides the circuit breaking function of the light switch and causes the lighting controlled by the switch to flash intermittently. This flashing occurs regardless of the initial state of the light switch, whether on or off. The result is an emergency visual signalling system to enhance the auditory output of an alarm system as well as to provide automatic lighting indoors or outdoors or at exits during an emergency. Thus, the device need not be preset in any manner and the device will automatically turn on and actuate the light intermittently regardless of whether the building is occuppied or unoccupied since activation of the automatic light signalling system is not required.

Most alarm systems, both residential and commercial, are installed to signal unwanted entry, fire or distress and usually have as their output signal an alarm bell or siren driven by a low voltage circuit. The new device adds an entirely separate visual addition to the auditory output by utilizing the existing indoor or outdoor lighting on the structure. In the event of an alarm, as detected by most currently available alarm systems, the bell or auxiliary output from the alarm system electrically activates the new device via a low power direct current connection to the new device which in turn causes the lighting supplied by the switch of the new device to flash in a cyclical manner. As an outdoor light begins to flash whether it has been previously on or off the effect is striking and obvious for the typical outdoor lighting. Depending upon the solid state or electromechanical voltage and wattage capacity of the device, a substantial number or wattage of lights can be caused to flash. In the most likely cases, a capability of up to 600 watts at 110 volts is sufficient, in particular, for private dwelling use.

DESCRIPTION OF THE PREFERRED EMBODIMENTS

Figure 1:
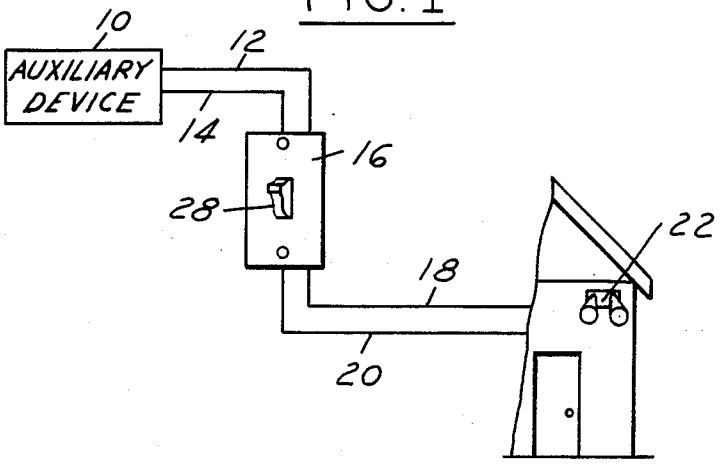
FIG. 1 illustrates an auxiliary alarm device, switch and light circuit.

Illustrated in FIG. 1 is an auxiliary device 10 which may comprise an alarm system smoke detector panic button or other device having upon actuation a low voltage direct current output through wires 12 and 14. The wires 12 and 14 are connected into a switch assembly 16 having the exterior appearance of a normal wall switch. The switch assembly 16 in turn is connected in conventional fashion through alternating current power lines 18 and 20 to interior or exterior lighting 22 on the dwelling or structure. The low voltage direct current wires operate at a voltage of from 6 to 24 volts and the alternating current power lines 18 and 20 are typically either 110 volts or 220 volts.

Figure 2:
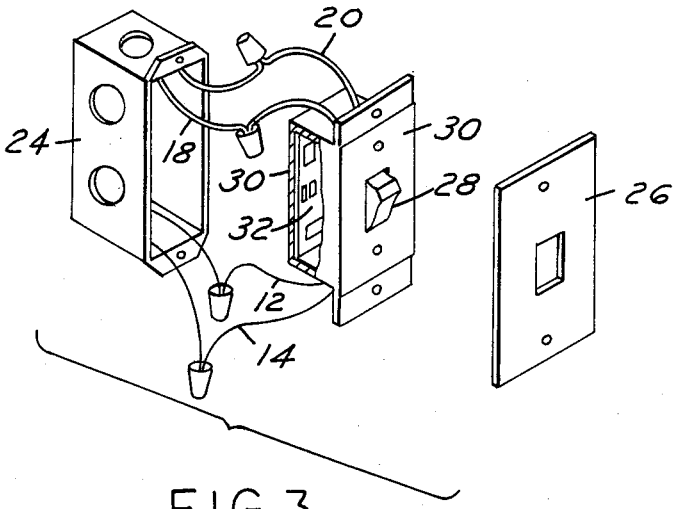
FIG. 2 is an exploded view of the new switch assembly.

The switch assembly 16 is illustrated in exploded view in FIG. 2 and comprises a protective enclosure 24 of conventional construction and a cover plate 26 also of conventional construction. Extending through the cover plate is a conventional two position switch 28 with the "normally on" position up and the "normally off" position down. A structure 30 supports the switch 28 and encloses electrical components 32 therebehind. Connected into the components 32 in the structure 30 are the low voltage wires 12 and 14 and the alternating current lines 18 and 20.

As shown by FIG. 2 the entire automatic light signalling system fits within the standard light switch enclosure for residential lighting and can be simply wired and connected into place in substitution for the conventional light switch with the exception of the two additional low voltage wires 12 and 14 from the auxilliary device 10. The installation is very simple in comparison with prior art devices.

Figure 3:
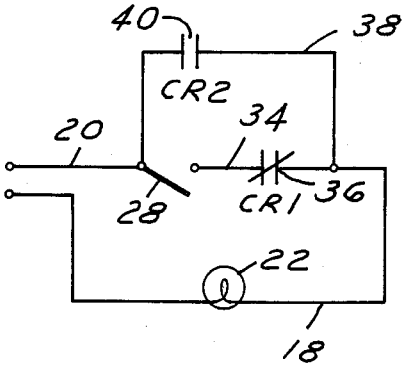
FIG. 3 is an electrical schematic of the relay controlled light power circuit.
Figure 4:
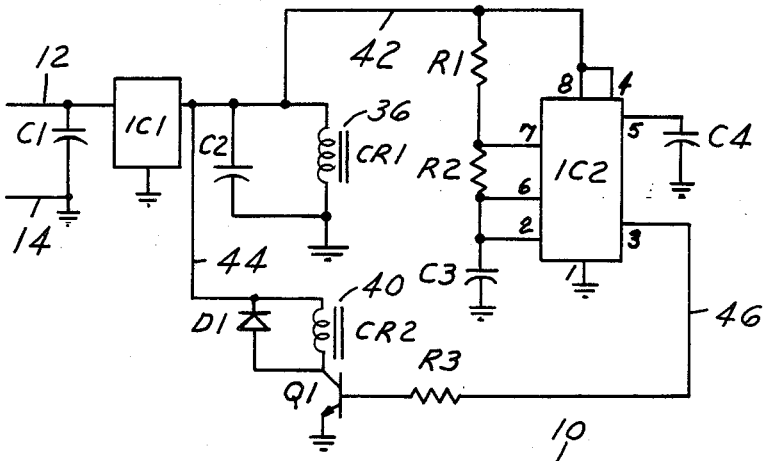
FIG. 4 is an electrical schematic of the control circuit.

Disclosed in FIGS. 3 and 4, respectively, are the alternating current and the direct current circuits 32 contained within the structure 30. In FIG. 3 the alternating current circuit line 20 leads to switch 28 which may selectably open and close a circuit 34 leading through a normally closed relay 36 to line 18. Line 18 in turn is connected to the lighting 22. A bypass circuit 38 through a normally open relay 40 extends about the switch 28 and relay 36. Thus, closure of relay 40 bypasses manual switch 28 and provides power to the lighting 22.

In FIG. 4 the low voltage lines 12 and 14 are connected into a voltage regulating circuit comprising capacitor C1, integrated circuit IC1 and capacitor C2. Integrated circuit IC1 regulates any applied direct current voltage of between 6 and 24 volts down to 5 volts direct current. Capacitors C1 and C2 are included to filter out any alternating current noise which may be input on wires 12 and 14. Thus, upon actuation of the auxiliary device, a regulated 5 volts direct current is supplied to circuits 42 and 44.

Connected to ground from circuit 42 is the solenoid CR1 of relay 36 which upon application of the 5 volts direct current in circuit 42 will energize, opening the contact of the relay 36 in FIG. 3. Thus, if the lighting 22 is on, i.e., the switch 28 is closed, the lighting will be turned off temporarily.

Circuit 42 supplies the 5 volts regulated current to a timing circuit comprising integrated circuit IC2, capacitors C3 and C4 and resistors R1 and R2. The timing circuit provides a pulse of direct current and voltage on line 46 at a rate determined by the values of the resistors R1 and R2 and the capacitor C3. Typically, the flashing rate will by approximately one cycle per second. With a current pulse in line 46 to the base of transistor of Q1, the transistor Q1 turns on and current passes through line 44 and solenoid CR2 of relay 40 thereby closing the contacts of the normally open relay 40 in FIG. 3. Thus, pulses of electric power at approximately one cycle per second close and open relay 40 energizing the lighting 22 at the same cyclic rate.

Since switch 28 and relay 36 are bypassed, the position of switch 28 is irrelevant to the operation of the lighting 22 when an alarm signal is supplied to wires 12 and 14. The flashing of the lighting will continue until the direct current supply on wires 12 and 14 is removed. The flyback diode D1 included in circuit 44 assists in dissipating the power in the solenoid CR2 of relay 40 as the magnetic field decays during the off portion of the timing cycle.

The low voltage circuitry illustrated in FIG. 4 is entirely powered by the input direct current on wires 12 and 14 and therefore uses no power when not activated by the auxillary alarm device. Thus, the automatic light signalling system uses no electric power and incurs no additional electric power expense except for those rare moments when actuated by the auxiliary alarm device.

Figure 5:
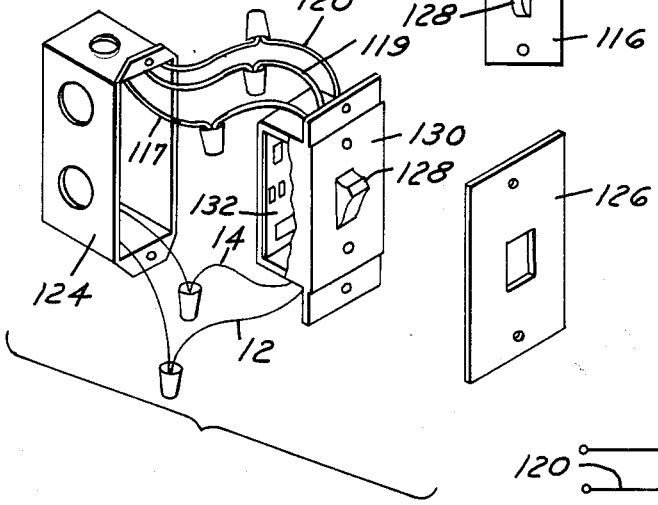
FIG. 5 is an exploded view of an alternate form of the switch assembly.
Figure 7:
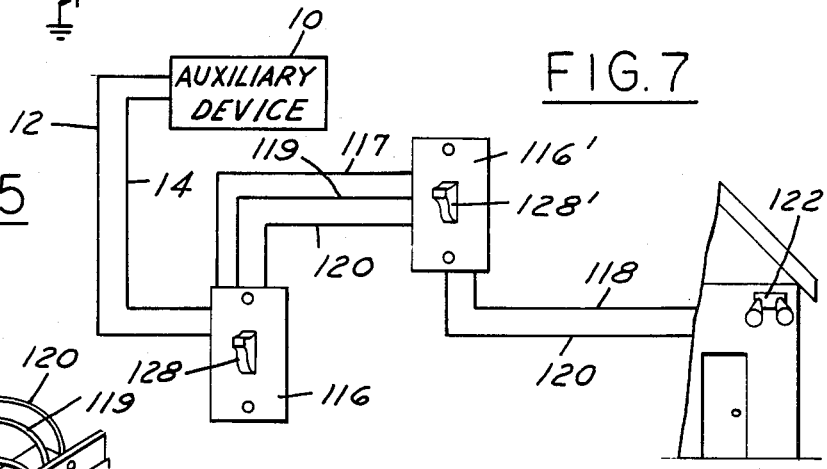
FIG. 7 illustrates a double switch, auxiliary alarm device and light circuit.
Figure 6:
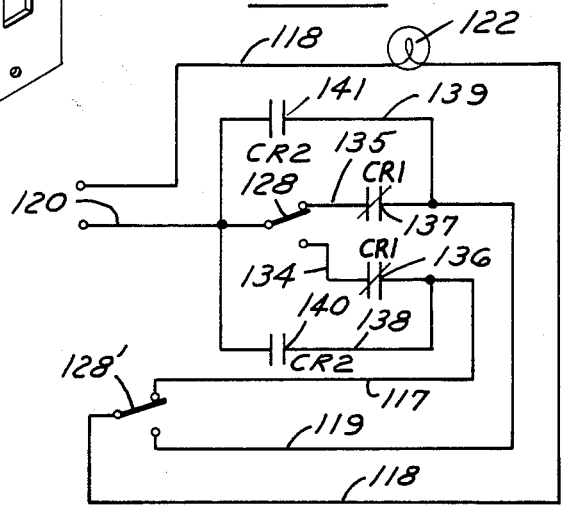
FIG. 6 is an electrical schematic of an alternate double switch form of the relay controlled light power circuit.

Referring to FIGS. 5, 6 and 7 an alternative embodiment of the invention is illustrated for a separated double switch installation. In FIG. 7 the auxillary device 10 supplies direct current through wires 12 and 14 at a voltage of between 6 and 24 volts to a switch assembly 116. A second switch assembly 116' at another location such as the opposite end of a large room is connected to switch assembly 116 by three alternating current lines 117, 119 and 120. Connecting switch assembly 116' to indoor or outdoor lighting 122 are two alternating current lines 118 and 120.

Referring to FIG. 5 the automatic light signalling system is contained in circuitry 132 within a structure 130 in turn contained within the protective enclosure 124 and face plate 126. Low voltage direct current wires 12 and 14 are connected into the circuitry 132 and the three alternating current lines 117, 119 and 120 are also connected into the circuitry 132. A two position switch 128 extends through the front of the structure 130 and the face plate 126. Switch assembly 116' however, comprises a conventional three wire two position switch as better illustrated at 116' in FIG. 6.

Referring to FIG. 6 the alternating current circuitry for the alternative embodiment has the switch 128 manually connectable to either of two internal circuits 134 or 135. Circuit 134 includes a normally closed relay 136 and circuit 135 includes a normally closed relay 137. In addition, a bypass circuit 138 having a normally open relay 140 connects line 120 to line 117. A second bypass circuit 139 having a second normally open relay 141 connects line 120 with line 119. Lines 117 and 119 connect the internal circuitry 132 with the two poles of switch 116'. Thus, if switch 116' is connected to line 117 and switch 128 is connected to circuit 135 as shown, the light is off. Movement of either switch to the other position will cause the lighting 122 to turn on in a conventional fashion.

The relays disclosed in the alternating current circuit shown in FIG. 6 are controlled by the circuit disclosed in FIG. 4 in the same manner as with the single switch circuit shown in FIG. 3. In particular, upon the introduction of an alarm voltage and current to wires 12 and 14, the solenoid CR1 of relay 36 in FIG. 4 will in this alternative embodiment open both relay 136 and relay 137 in FIG. 6. The opening of relays 136 and 137 effectively remove switch 128 from control of the lighting 122. However, the timed on and off operation of relay solenoid CR2 in the circuit shown in FIG. 4 causes the relays 140 and 141 to be opened and closed cyclically and simultaneously. Regardless of which position switch 116' is in, the lighting 122 will cycle on and off in accordance with the timing circuit of FIG. 4. In summary therefore, regardless of the switch positions in the alternative embodiment, the alarm circuit will override the manual switching circuits and cycle the lighting 122 on and off.

As an example, a suitable integrated circuit IC1 can be an LM7805CT 5 volt regulator available from companies such as National Semiconductor, Motorola or RCA. Integrated circuit IC2 can be an LM555CN timer available from the same manufacturers. Other components may be listed as follows:

R1: 1 megohm
R2: 680 kilohm
R3: 2 kilohm
C1: 10 micro farad electrolytic
C2: 0.47 micro farad electrolytic
C3: 1 micro farad electrolytic
C4: 0.01 micro farad
D1: 1 ampere, 100 volt
Q1: 0.6 ampere, 40 volt The relays are available from Fujitsu. For the single switch application, both relays 36 and 40 can be FBR111UD005W models. For the alternative dual switch model, both relays 136 and 140 control dual open and close points and can be FBR625D005 and FBR623D005 models respectively available from Fujitsu. In addition, the manually operated switch 28 or 128 is a model 572-1121-0504-013 single pole double throw unit available from Dialight. The above components are given for example purposes only and equivalent components or components having different ratings may be substituted for applications that require different voltage inputs from the alarm auxiliary device or different voltage and current requirements for the lighting.

Although the description of the apparatus herein constitutes the preferred embodiment of this invention, it is to be understood that the invention is not limited to these precise forms of apparatus and changes may be made to the apparatus without departing from the scope of the invention which is defined in the appended claims.

We claim:

1. An electric light signalling system comprising a lighting circuit and a control circuit, the lighting circuit comprising at least one manually operable switch and normally closed relay in series therewith, a bypass circuit comprising a normally open relay in parallel with said switch and normally closed relay, said lighting parallel circuits connectable to a source of power and to lighting in series therewith, the control circuit comprising means to regulate an input voltage, a first relay solenoid in parallel with the input voltage regulation means, a second relay solenoid and means to momentarily interrupt the electric current through the second relay solenoid in series therewith, said second solenoid and interrupt means in parallel with the first relay solenoid.

cyclic timing means connected to said interrupt means, said cyclic timing means actuatable by the means to regulate an input voltage, said normally closed relay actuatable by the first relay solenoid, and said normally open relay actuatable by the second relay solenoid in response to cyclic actuation of the interrupt means.

2. The electric light signalling system of claim 1 wherein said control circuit is powered solely to the input voltage and current to the voltage regulation means.

3. The electric light signalling system of claim 1 wherein the interrupt means comprises a transistor with the base connected to the cyclic timing means.

4. The electric light signalling system of claim including a structure, said control circuit and said lighting circuit mounted in said structure, and said structure mountable in a protective enclosure in replacement for a conventional light switch.

5. An electric light signalling system comprising a lighting circuit and a control circuit the lighting circuit comprising a first manually operable switch and a normally closed relay connected in series to each selectable pole of the first switch, bypass circuits comprising normally open relays each in parallel with the first switch and each in parallel with one of the normally closed relays thereby bypassing the switch and normally closed relay circuits, the control circuit comprising means to regulate an input voltage, a first relay solenoid in parallel with the input voltage regulation means, a second relay solenoid and means to momentarily interrupt the electric current through the second relay solenoid in series therewith, said second relay solenoid and interrupt means in parallel with the first relay solenoid, cyclic timing means connected to said interrupt means, said cyclic timing means actuable by the means to regulate an input voltage, said normally closed relays actuable by the first relay solenoid, and said normally open relays actuable by the second relay solenoid in response to cyclic actuation of the interrupt means.

6. The electric light signalling system of claim 5 including a second manually operable switch, each pole of said second switch connected in series to one of said normally closed relay circuits and one of said bypass circuits.

7. The electric light signalling system of claim 5 wherein said interrupt means comprises a transistor, the base of said transistor connected to the cyclic timing means.

8. The electric light signalling sytem of claim 5 including a structure, said control circuit and said lighting circuit mounted in said structure, and said structure mountable in a protective enclosure in replacement for a conventional light switch.

9. The electric light signalling system of claim 5 wherein said control circuit is powered solely by the input voltage and current to the voltage regulation means.

* * * * *

UNITED STATES PATENT AND TRADEMARK OFFICE

CERTIFICATE OF CORRECTION

PATENT NO. : 4,642,477

DATED : February 10, 1987

INVENTOR(S) : Edmund S. Grzanowski, Jr. et al.

It is certified that error appears in the above-identified patent and that said Letters Patent are hereby corrected as shown below:

Col. 2, line 28: Correct "occuppied" to -- occupied --.

Col. 6, line 10: Delete "to" and substitute -- by --.

Col. 6, line 16: After "claim" insert -- 1 --.

Signed and Sealed this

Twenty-second Day of September, 1987

*Attest:*

DONALD J. QUIGG

*Attesting Officer* *Commissioner of Patents and Trademarks*